US008771034B2

(12) United States Patent
Mak Wing Kwong

(10) Patent No.: US 8,771,034 B2
(45) Date of Patent: Jul. 8, 2014

(54) SLOT CAR AND MULTI-SLOT TRACK COMBINED RACEWAY

(75) Inventor: David Mak Wing Kwong, Shatin (HK)

(73) Assignee: Wing Dynasty Limited, Hong Kong (HK)

( * ) Notice: Subject to any disclaimer, the term of this patent is extended or adjusted under 35 U.S.C. 154(b) by 477 days.

(21) Appl. No.: 13/296,257

(22) Filed: Nov. 15, 2011

(65) Prior Publication Data

US 2012/0196506 A1 Aug. 2, 2012

(30) Foreign Application Priority Data

Jan. 28, 2011 (CN) ..... 2011 1 0031639

(51) Int. Cl.
*A63H 18/10* (2006.01)
*A63H 18/08* (2006.01)

(52) U.S. Cl.
CPC ..... *A63H 18/08* (2013.01)
USPC ..... 446/441; 446/446

(58) Field of Classification Search
USPC ..... 446/441, 446, 460, 456, 129, 465, 444, 446/445; 104/242, 304, 305
See application file for complete search history.

(56) References Cited

U.S. PATENT DOCUMENTS

| | | | | |
|---|---|---|---|---|
| 4,479,650 | A * | 10/1984 | Neuhierl | 463/63 |
| 4,795,154 | A * | 1/1989 | Lahr | 104/242 |
| 7,090,556 | B2 * | 8/2006 | Maleika | 446/446 |
| 7,837,532 | B2 * | 11/2010 | Reuter | 446/444 |
| 2006/0141902 | A1 | 6/2006 | Sinisi | |

FOREIGN PATENT DOCUMENTS

| | | |
|---|---|---|
| CN | 2407808 | 11/2000 |
| CN | 1708335 | 12/2005 |
| DE | 102006059518 | 6/2008 |
| EP | 0567296 | 4/1993 |

* cited by examiner

*Primary Examiner* — Nini Legesse

(57) ABSTRACT

The invention discloses a slot car including a body, a power mechanism for driving the body, and an adjusting assembly for track switching of the body. The adjusting assembly includes a rotating component driven by the power mechanism, a guiding component fixed on the body, and multiple slot-pins. The guiding component includes a guide channel used for annular position limiting of the slot-pin and multiple position limiters used for longitudinal position limiting of the slot-pin, and the rotating of the rotating component enables the sliding of the slot-pin within the guide channel. The invention further provides a Multi-slot track combined raceway on which the slot car travels. With the adjusting assembly, the slot car is enabled to switch between tracks. The slot car is enabled to freely intercept its counterparts by switching tracks, thus the entertainment is enhanced.

20 Claims, 11 Drawing Sheets

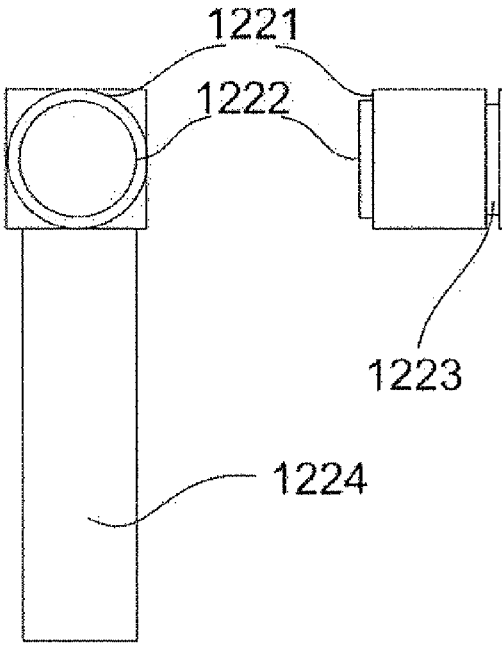
Figure 11
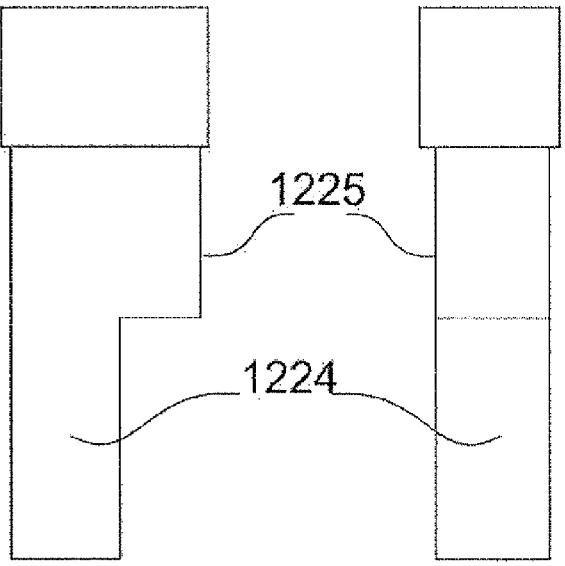
Figure 12
Figure 13
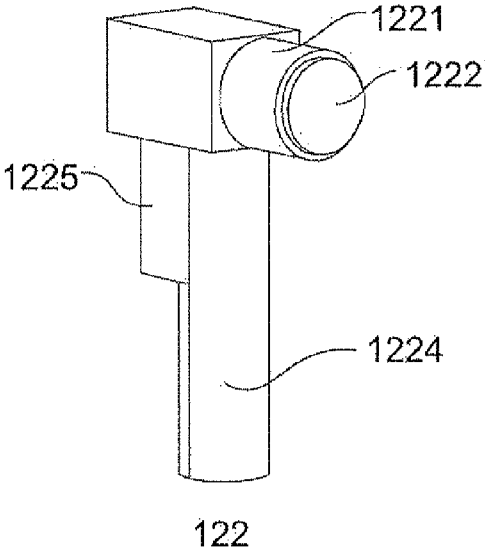
Figure 14
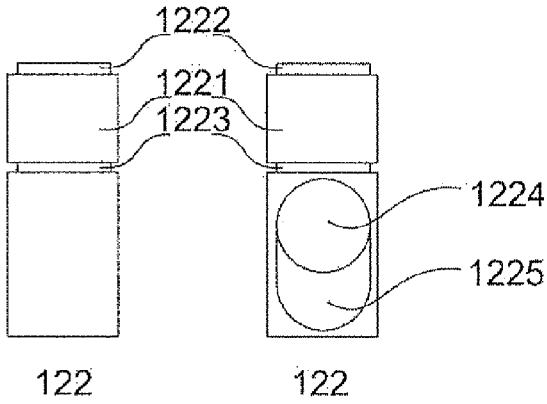
Figure 15
Figure 16

SLOT CAR AND MULTI-SLOT TRACK COMBINED RACEWAY

FIELD OF THE INVENTION

The present application relates to the field of toy car, and particularly to a slot car which travels on a track and a Multi-slot track combined raceway.

BACKGROUND OF THE INVENTION

The existing slot car, which is normally a four-wheel drive type, is provided fixedly with a slot-pin at the bottom of its front part to guide the car moving forward by following the slot in the track, cooperates with semi-closed track modules, and is powered by the track or by itself. The slot car is engaged on the track, and travels on the track's slot by means of the slot-pin. The slot-pin, which is engaged into the track's slot, are constrained by slots of the track in a transverse direction, so that the slot car cannot freely be switched from one slot to another slot in the track, that is, the slot car merely travels along the same slot of the raceway. During the racing, a plurality of slot cars travel along their own slot of the tracks or move to the other slot in a we-fixed cross point of the slot, respectively, and compete with each other by their speeds, in this case, the fastest slot car can win the race. The existing slot car is disadvantageous in that it cannot travel across or switch the slot in the track at any location on the track, and thus cannot intercept or block its counterparts regardless of spots and time. As a result, the entertainment, attraction and excitation of the slot car is insignificant, thus reducing interests in the slot car and its play patterns.

SUMMARY OF THE INVENTION

A technical problem to be addressed by the present invention is to provide a slot car and a Multi-slot track combined raceway to overcome the existing defects in the prior art that a slot car cannot freely travel across or switch between slots of the tracks.

A technical solution for addressing the above problem includes a slot car which includes a body, a power mechanism for driving the body, and an adjusting assembly used for slot switching of the body, wherein the adjusting assembly includes a rotating component driven by the power mechanism, a guiding component fixed on the body, and a plurality of slot-pins, the guiding component includes a guide channel used for annular position limiting of the slot-pin and a plurality of position limiters used for longitudinal position limiting of the slot-pin, and the rotating of the rotating component enables the sliding of the slot-pin within the guide channel.

Preferably, in the slot car of the invention, the guide channel includes a lower spot along a longitudinal direction of the guide channel.

Preferably, in the slot car of the invention, the guide channel includes two lower spots arranged symmetrically along a longitudinal direction of the guide channel.

Preferably, in the slot car of the invention, the guiding component includes an annular shell fixed on the body, and the guide channel is provided on an internal wall of the shell.

Preferably, in the slot car of the invention, the guiding component includes an annular shell fixed on the body, the shell is provided internally with a cylinder fixedly, and the guide channel is fixed on the cylinder.

Preferably, in the slot car of the invention, the position limiter is a U-shaped chute.

Preferably, in the slot car of the invention, the position limiter includes two parallel baffles.

Preferably, in the slot car of the invention, the slot-pin includes a positioning end and a guiding end arranged perpendicularly with respect to the positioning end.

Preferably, in the slot car of the invention, the rotating component includes a connecting pole connected with the power mechanism, and the connecting pole is fixedly connected with the plurality of position limiters.

Preferably, in the slot car of the invention, the rotating component includes a base, on which the connecting pole and the position limiters are fixed.

Preferably, in the slot car of the invention, an identity coding module used for recording a race result is provided in the body, and the identity coding module includes an interface for transmitting information to the Internet.

The invention further provides a Multi-slot track combined raceway on which the slot car travels, including a plurality of connected tracks, wherein the tracks includes a plurality of recessed track slots used for engaging with a slot-pin of the slot car, and an adjust component of the slot car is used for adjusting the movement of the slot-pin within the track slot so that the slot car is allowed to switch from one track slot to another track slot.

The beneficial effects of the invention include that: with the provided adjusting assembly cooperating with the Multi-slot track combined raceway, the annular guide channel of the guiding component annularly limits the position of the slot-pin, while the position limiter of the rotating component longitudinally limits the position of the slot-pin, thereby enabling the slot car to switch between tracks. During a race, the slot car is enabled to freely intercept or block, its counterparts regardless of time and location by switching tracks, as a result, the entertainment, attraction and excitation of the slot car is enhanced.

Further, an identity coding module is introduced to the body of the slot car to record a race result, and a racer can download a winning record of racing over the Internet, so as to provide an information space for race result sharing that is more encouraging and broader.

BRIEF DESCRIPTION OF THE DRAWINGS

The present invention is further described below in connection with embodiments and the attached drawings, in which.

FIG. 11 is a schematic front view of a slot-pin of the adjusting assembly of the slot car of the invention;

FIG. 12 is a schematic right view of the slot-pin of the adjusting assembly of the slot car of the invention;

FIG. 13 is a schematic back view of the slot-pin of the adjusting assembly of the slot car of the invention;

FIG. 14 is a schematic perspective view of the slot-pin of the adjusting assembly of the slot car of the invention;

FIG. 15 is a schematic top view of the slot-pin of the adjusting assembly of the slot car of the invention;

FIG. 16 is a schematic bottom view of the slot-pin of the adjusting assembly of the slot car of the invention;

Figure 1:
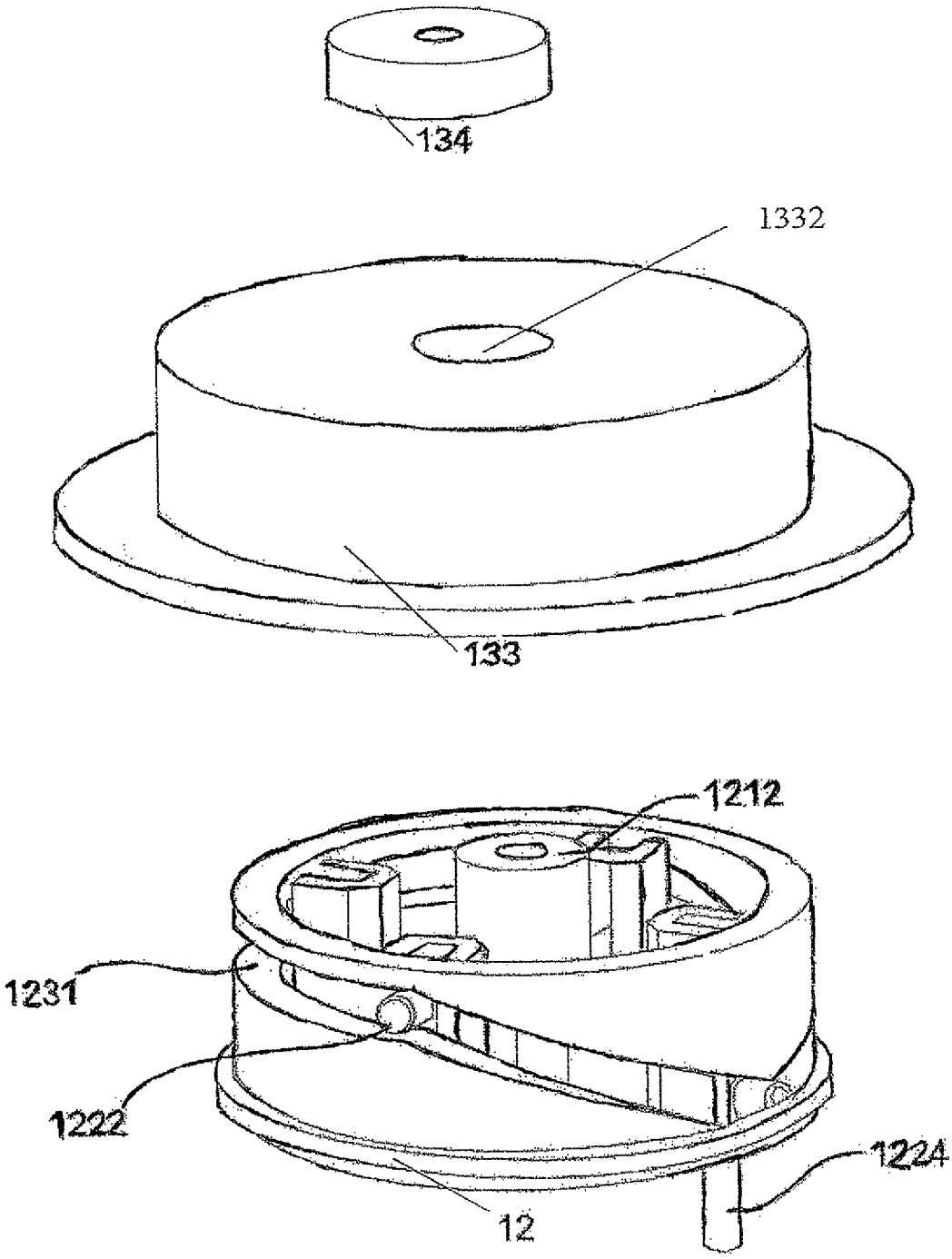
FIG. 1 is a schematic exploded view of an adjusting assembly of a slot car of the invention.
Figure 2:
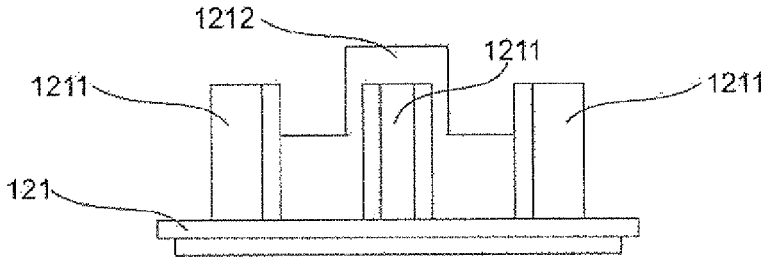
FIG. 2 is a schematic front view of a rotating component of the adjusting assembly of the slot car of the invention.
Figure 3:
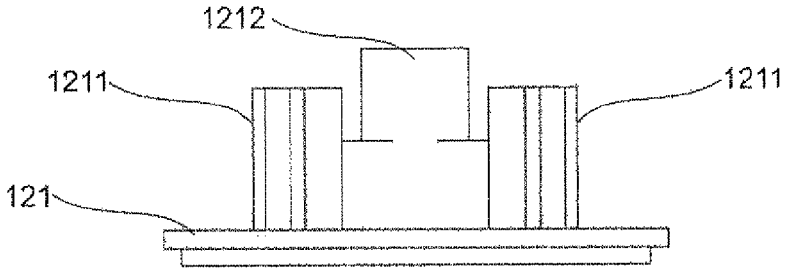
FIG. 3 is a schematic left view of the rotating component of the adjusting assembly of the slot car of the invention.
Figure 4:
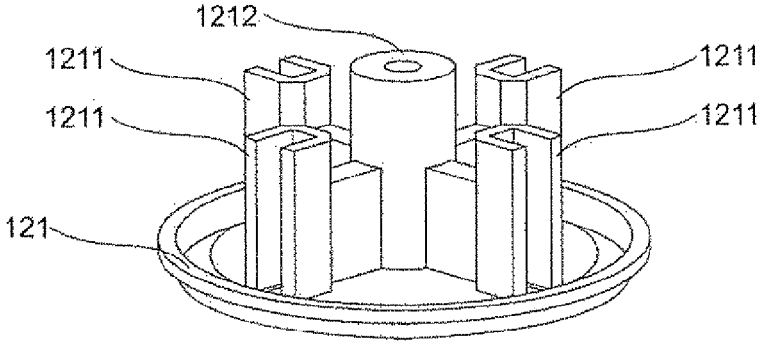
FIG. 4 is a schematic perspective view of the rotating component of the adjusting assembly of the slot car of the invention.

| Reference numerals | |
|---|---|
| 11: Track | 116: Track |
| 111: Track Slot | 112: Track Face |
| 12: Rotating Component | 121: Base |
| 122: Slot-pin | |
| 1211: U-shaped Sliding Slot | 1212: Connecting Pole |
| 1213: Through hole | 122a: Slot-pin |
| 122b: Slot-pin | 122c: Slot-pin |
| 122d: Slot-pin | 1221: Guiding End |
| 1222: Protruding Step | 1223: Engaging portion |
| 1224: Positioning End | 1225: Protrusion |
| 123: Cylinder | 1231: Guide channel |
| 133: Shell | 1331: Screwed Hole |
| 1332: Through Hole | 134: Lid |

DETAILED DESCRIPTION OF THE EMBODIMENTS

Particular embodiments of the invention are described in detail below with reference to the attached drawings, for the purpose of clearly understanding technical features, objects and effects of the invention.

Figure 21:
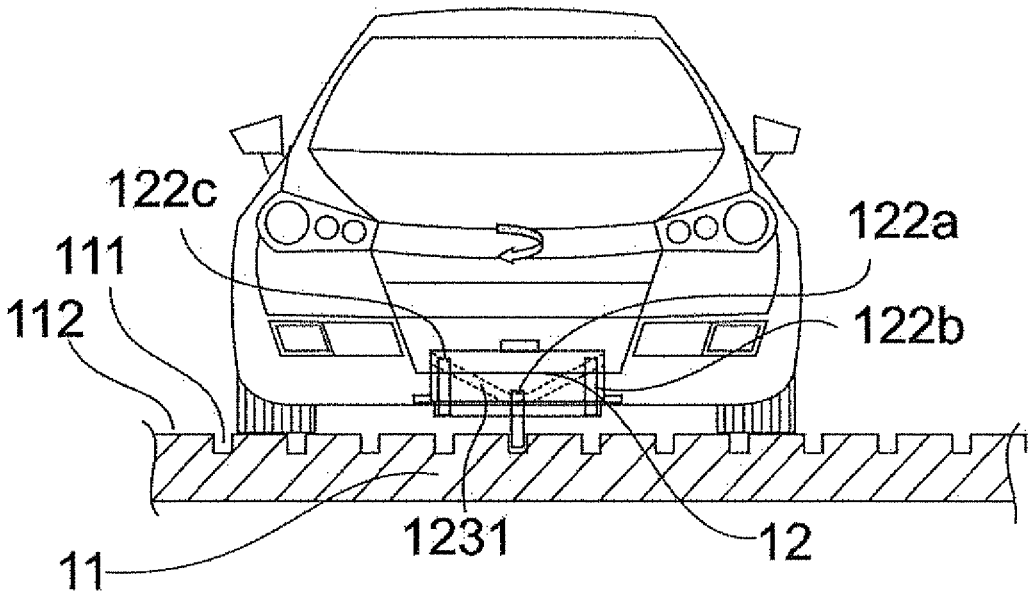
FIG. 21 is a schematic diagram showing a first position of the slot car of the invention when switching the track.
Figure 23:
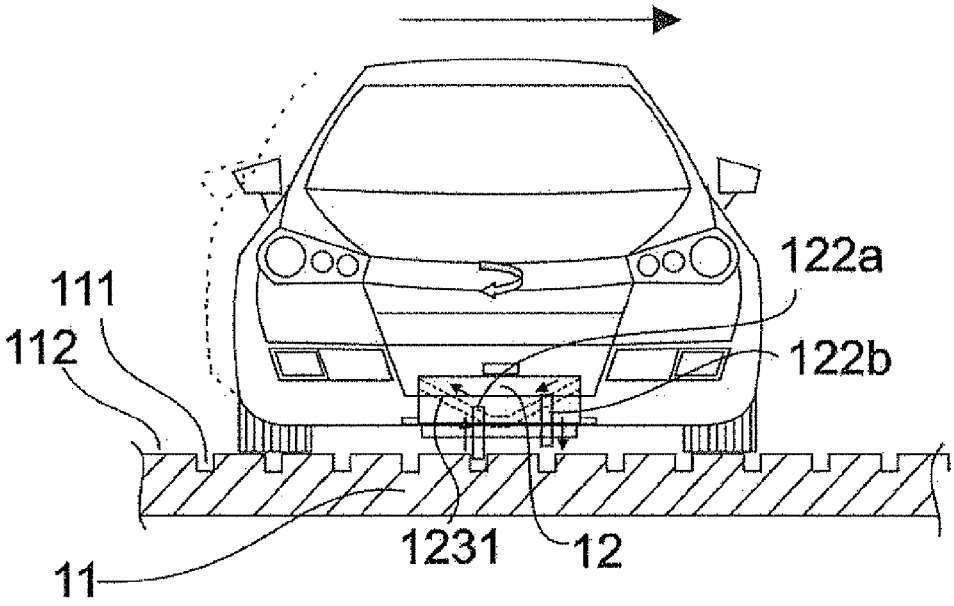
FIG. 23 is a schematic diagram showing a second position of the slot car of the invention when switching the track.
Figure 25:
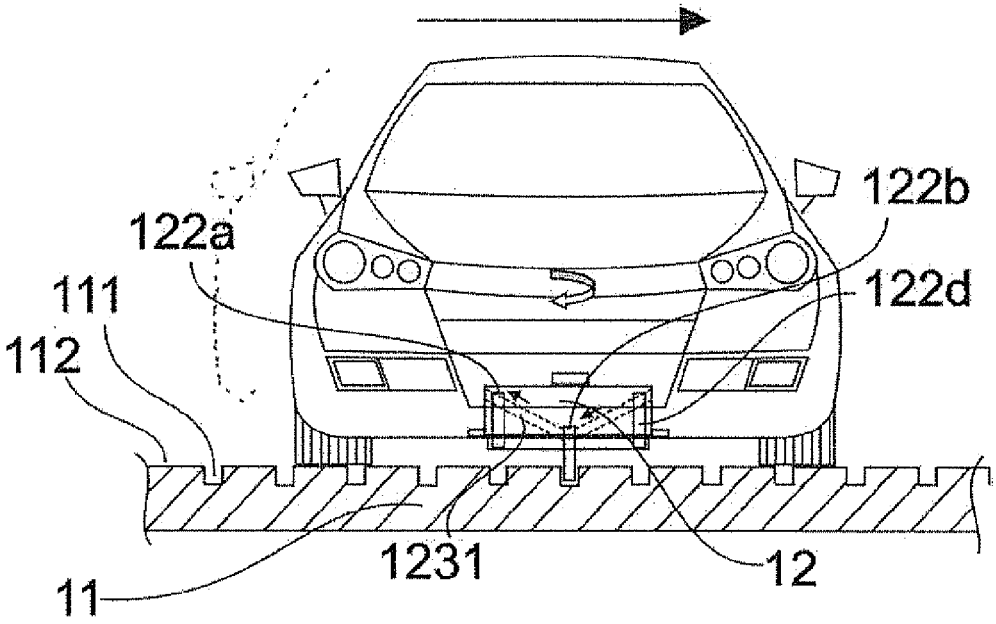
FIG. 25 is a schematic diagram showing a third position of the slot car of the invention when switching the track.

An embodiment of the invention is shown in FIGS. 21, 23 and 25, and a slot car including a body and a power mechanism for driving the body is disclosed. The body may be a typical slot car, and the power mechanism, which may be a motor actuating mechanism or a gearing, provides power for the slot car. The invention is advantageous in that an adjusting assembly used for the slot switching is included. As shown in FIG. 1, the adjusting assembly includes a rotating component 12 driven by the power mechanism, a guiding component fixed on the body, and a plurality of slot-pins 122*a*, 122*b*, 122*c* and 122*d* which are movably arranged between the guiding component and the rotating component 12. The rotating component 12 may be rotated with the driving by the power mechanism. Alternatively, it may be appreciated that the rotating component 12 may be provided separately with an actuating mechanism. As shown in FIGS. 7-10, the guiding component includes a guide channel 1231 for annular position limiting of the slot-pin, and one end of the slot-pin is engaged within the guide channel 1231. The rotating component 12 includes a plurality of position limiters for longitudinal position limiting of the slot-pin. The plurality of position limiters are arranged in angles, and the other end of the guide channel 1231 is limited by the position limiters and hence is allowed for longitudinal movement merely. The rotating of the rotating component 12 enables the rotating of the position limiters, which in turn enables the sliding of the slot-pin within the guide channel 1231.

In the present embodiment, preferably four position limiters peripherally distributed equally are included, and the adjacent position limiters are arranged in an angle of 90 degrees. It may be appreciated that slot-pins match the position limiters, respectively. In the present embodiment, there are preferably four slot-pins, i.e. slot-pins 122*a*, 122*b*, 122*c*, and 122*d*, as shown in FIGS. 20, 22, 24 and 26, and the adjacent position limiters are arranged in an angle of 90 degrees.

As shown in FIGS. 11-16, the slot-pin includes a positioning end 1224 and a guiding end 1221 arranged perpendicularly with respect to the positioning end 1224. For the sake of engagement of the guiding end 1221 within the guide channel 1231, an engaging portion 1223 is arranged between the positioning end 1224 and the guiding end 1221, and has a diameter slightly less than that of the guiding end 1221. A protruding step 1222 is provided on an end face of the guiding end 1221. In addition, a protrusion 1225 is arranged at one side of the positing end 1224, to facilitate the installment of the slot-pins.

The guiding end 1221 of the slot-pin is engaged in the guide channel 1231 and may slide along the guide channel 1231, and thus the movement track of the guiding end 1221 depends on the shape of the guide channel 1231. The guide channel 1231 varies in height along its longitudinal direction, to achieve longitudinal displacement of the positioning end 1224 of the slot-pin.

In a first embodiment of the guide channel, as shown in FIGS. 7-10, the guide channel 1231 includes a lower spot along the longitudinal direction of the guide channel 1231. The declining chute sections at both sides of the lower spot are connected to chute sections at the higher spots. When the slot-pin runs from the chute section at the higher spot of the guide channel 1231 to the lower spot, the other end of the slot-pin displaces longitudinally. The guide channel with one lower spot is suitable for both a winding track and a straight track.

In a second embodiment of the guide channel, the guide channel includes two lower spots along its longitudinal direction. The two lower spots are distributed symmetrically, and are connected through an arciform chute. The chute of such a structure is suitable for a straight track. When the slot car switches between straight tracks, both the front and rear slot-pins are located at the two lower spots of the guide channel, and are inserted simultaneously in the track slot, so that the slot car can switch between tracks more smoothly.

In a first embodiment of the guiding component, as shown in FIGS. 1, and 7-10, the guiding component includes an annular shell 133 which is hollow and fixed on the body, and the guide channel 1231 is recessed on the internal wall of the shell 133. The shell 133 further includes an edge extending outwards, along which screwed holes 1331 are arranged, so that the shell 133 may be fixed under the bottom of the body through screws. It will be appreciated that the shell 133 can also be fixed under the bottom of the body through welding, riveting, snap fitting, etc.

In a second embodiment of the guiding component, a difference from its first embodiment lies in that a cylinder 123 is fixed within the hollow cavity of the shell 133, and the guide channel 1231 is fixed on the cylinder 123. The guide channel 1231 passes through the cylinder 123, and both the upper and lower ends of the cylinder 123 are fixedly welded, screwed, or riveted on the shell 133.

Figure 5:
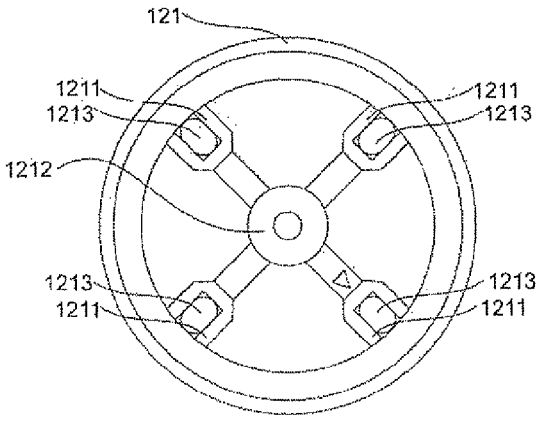
FIG. 5 is a schematic top view of the rotating component of the adjusting assembly of the slot car of the invention.
Figure 6:
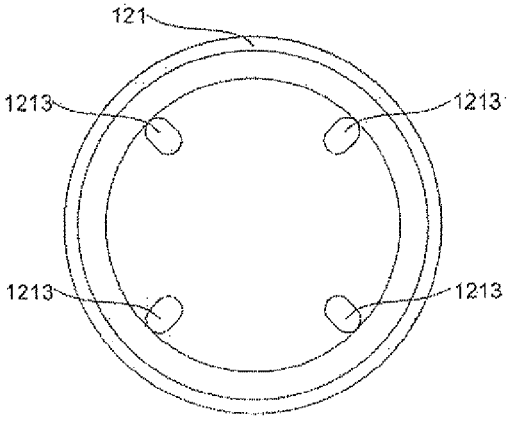
FIG. 6 is a schematic bottom view of the rotating component of the adjusting assembly of the slot car of the invention.
Figure 7:
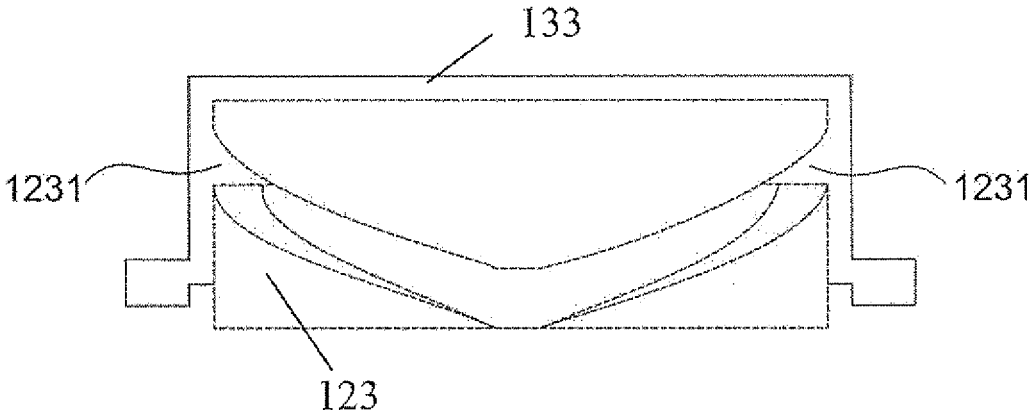
FIG. 7 is a schematic front view of a guiding component of the adjusting assembly of the slot car of the invention.
Figure 8:
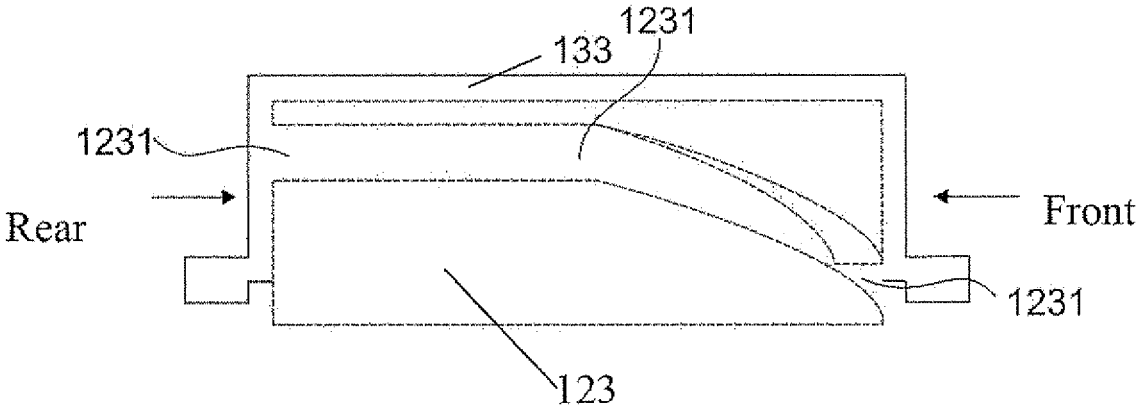
FIG. 8 is a schematic left view of the guiding component of the adjusting assembly of the slot car of the invention.
Figure 9:
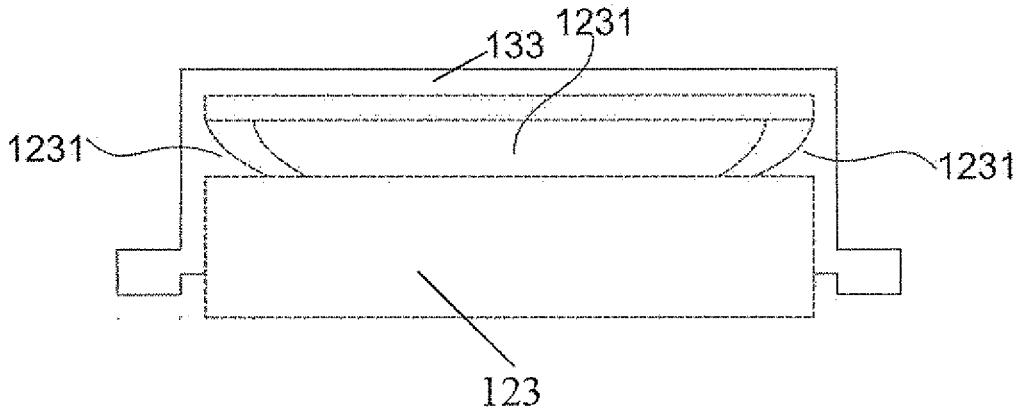
FIG. 9 is a schematic back view of the guiding component of the adjusting assembly of the slot car of the invention.
Figure 10:
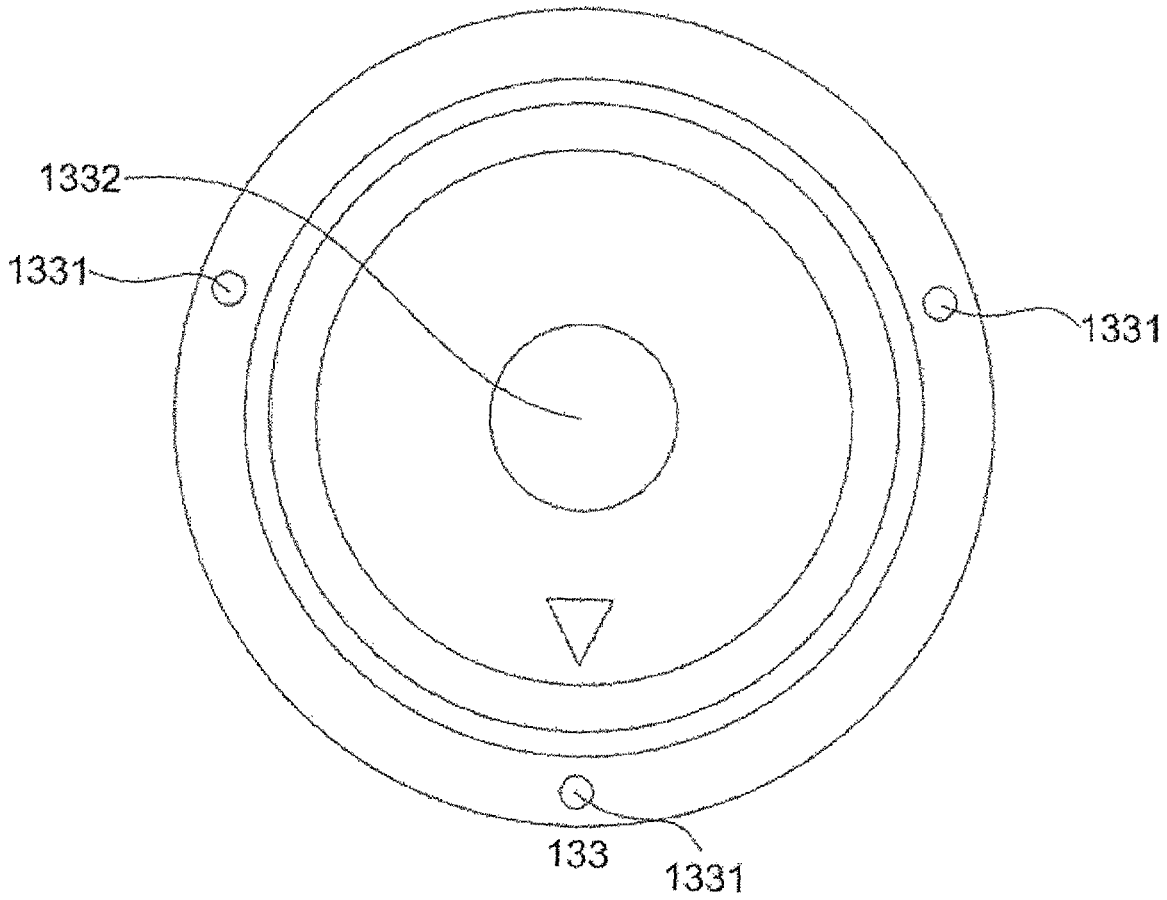
FIG. 10 is a schematic top view of the guiding component of the adjusting assembly of the slot car of the invention.

In a first embodiment of the position limiter, the position limiter is a U-shaped chute 1211. However, it will be appreciated that the position limiter may be alternatively a chute of a varying shape with an opening at one of its sides. The U-shaped chute 1211 is open on its end face, as shown in FIG. 5. The U-shaped chute 1211 is provided with a through hole 1213 on its end face, and the through hole 1213 is used for longitudinal movement of the positioning end 1224 of the slot-pin.

In a second embodiment of the position limiter, the position limiter includes two parallel baffles, between which the slot-pin is engaged, so that the positioning end 1224 of the slot-pin may move longitudinally along the baffles.

Figure 19:
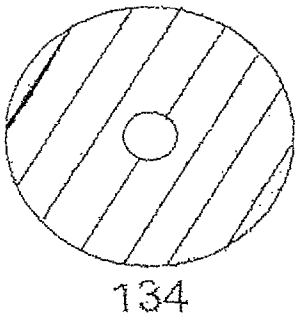
FIG. 19 is a schematic top view of the lid of the adjusting assembly of the slot car of the invention.
Figure 18:
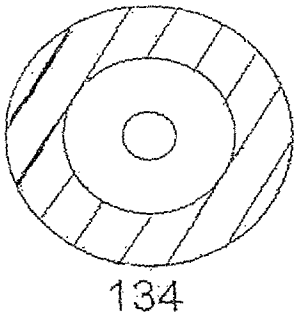
FIG. 18 is a schematic bottom view of the lid of the adjusting assembly of the slot car of the invention.
Figure 17:
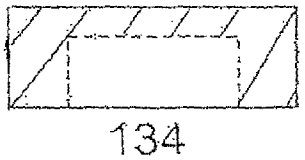
FIG. 17 is a schematic front sectional view of a lid of the adjusting assembly of the slot car of the invention.

In a first embodiment of the rotating component 12, as shown in FIGS. 2-6, the rotating component 12 includes a connecting pole 12 connected with the power mechanism. The connecting pole 12 is fixedly connected with four position limiters, and passes through and extends from the through hole 1332 centered at the top of the shell 133, to be fixedly connected with the lid 134 through screw. As shown in FIGS. 17-19, one end face of the lid is recessed, and the connecting pole 12 is fixedly connected with the recessed end face through screw. A shaft of the power mechanism passes through a hole of the lid and is connected fixedly with the central portion of the connecting pole 12. The power mechanism drives the connecting pole 12 to rotate, and the connecting pole 12 in turn causes the rotation movement of the four position limiters.

In a second embodiment of the rotating component 12, a difference from its first embodiment lies in that the rotating component 12 includes a base 121, on which the connecting pole 12 and position limiters are fixed. The power mechanism drives the connecting pole 12 to rotate through the shaft, so that the position limiter and the base 121 are rotated simultaneously.

Figure 20:
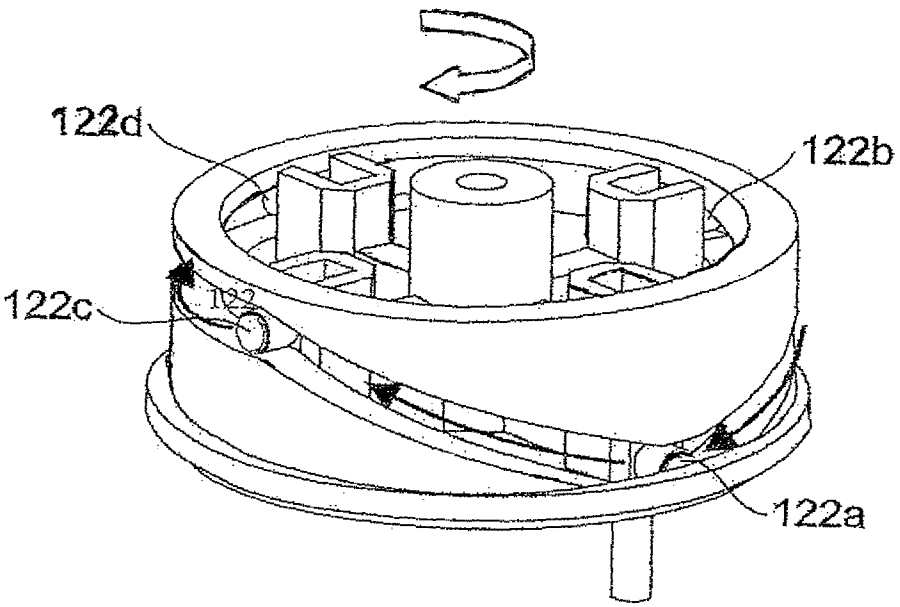
FIG. 20 is a schematic diagram indicating the movement of the slot-pin of the adjusting assembly of the slot car of the invention within a guide channel.
Figure 22:
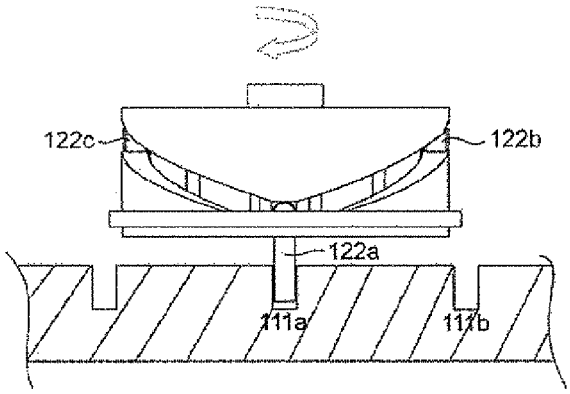
FIG. 22 is a schematic enlarged view of the adjusting assembly of FIG. 21.
Figure 24:
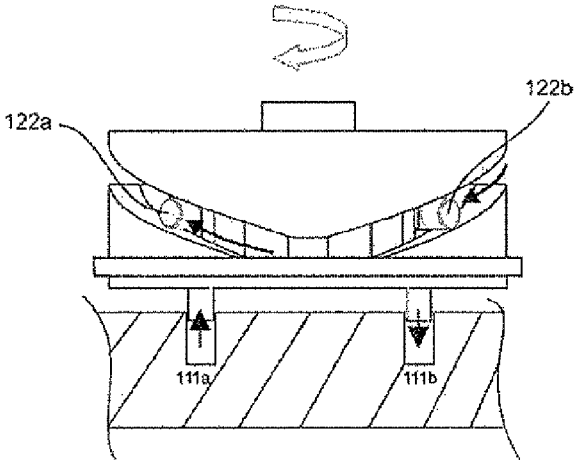
FIG. 24 is a schematic enlarged view of the adjusting assembly of FIG. 23.
Figure 26:
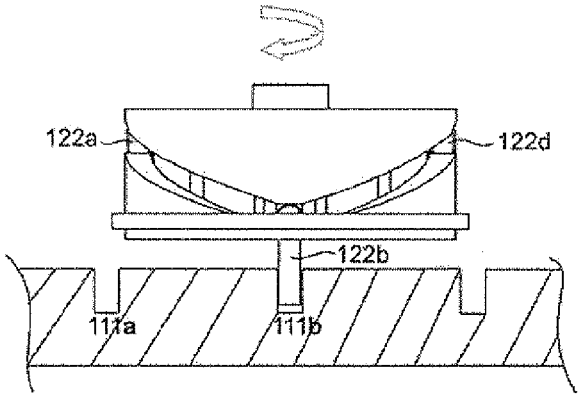
FIG. 26 is a schematic enlarged view of the adjusting assembly of FIG. 25.

The description below illustrates how the slot car of the invention switches between slots. As shown in FIG. 20, the slot-pins 122*a*, 122*b*, 122*c* and 122*d* are engaged in the guide channel 1231. As the connecting pole 12 rotates, the four slot-pins move not only longitudinally, but also annularly along the guide channel 1231. As shown in FIGS. 21 and 22, the positioning end 1224 of the slot-pin 122*a* is inserted in the track slot 111*a*. As shown in FIGS. 23 and 24, the four slot-pins rotate and displace, thus the positioning end 1224 of the slot-pin 122*a* slide away the lower spot of the guide channel 1231 while the slot-pin 122*b* gradually slides to the lower spot along the guide channel 1231. As a result, the positioning end of the slot-pin 122*a* will depart from its current slot and the positioning end of the slot-pin 122*b* will be inserted into the slot next to that of the slot-pin 122*a*. During such movement, when the positioning end of the slot-pin 122*b* reaches the lower spot, it is inserted into the track slot. The positioning end of the slot-pin 122*b* will take over the guiding role of the slot-pin 122*a* of the slot car. During such movement, the power mechanism can drive the whole car body to displace in a direction opposite to the direction in which the slot-pin 122*b* slides. As shown in FIGS. 25 and 26, the slot-pin 122*b* slides to the lower spot, and the positioning end 1224 of the slot-pin 122*b* is inserted in the track slot 111*b*.

Further, an identity coding module used for recording a race result is provided in the body of the slot car. In addition, the identity coding module includes an interface for transmitting information to the Internet, so that the race result recorded by the identity coding module can be transmitted to a web page via a data line and downloaded by a user or player logging onto the corresponding website.

Figure 28:
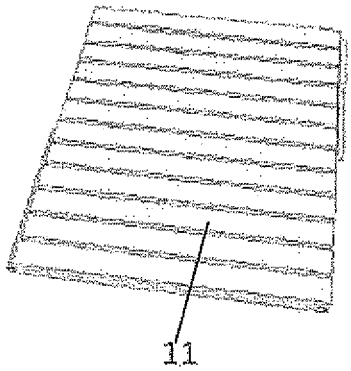
FIG. 28 is a schematic diagram showing the structure of a first track of the Multi-slot track combined raceway on which the slot car of the invention travels.
Figure 29:
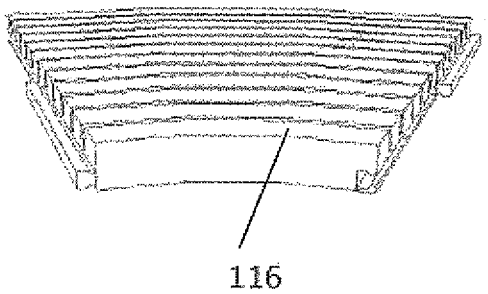
FIG. 29 is a schematic diagram showing the structure of a second track of the Multi-slot track combined raceway on which the slot car of the invention travels.
Figure 30:
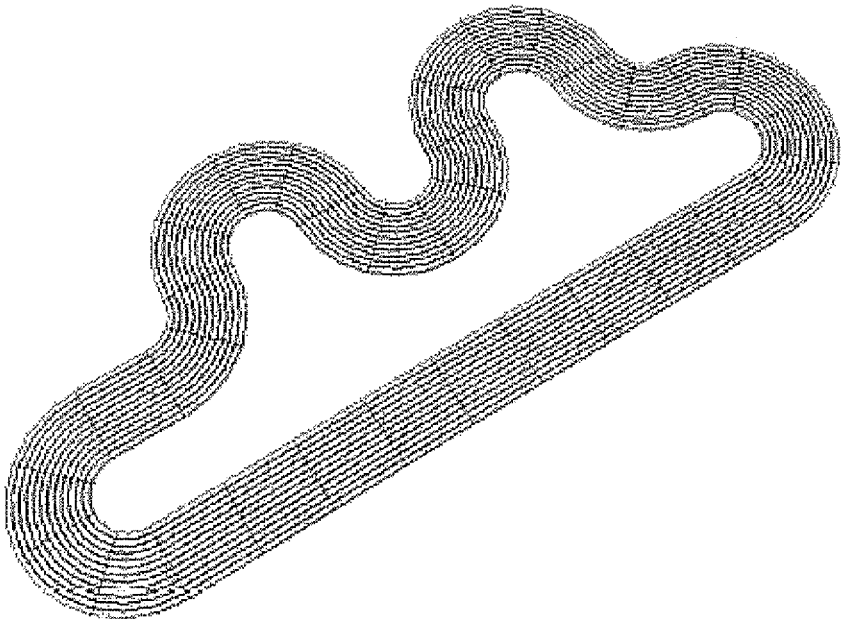
FIG. 30 is a schematic diagram showing the structure of the Multi-slot track combined raceway on which the slot car of the invention travels.

The slot car of the invention depends on a Multi-slot track combined raceway, which is composed of multiple tracks. FIG. 29 shows a track 116 used for a winding raceway while FIG. 28 shows a track 11 used for a straight raceway, and the tracks 116 and 11 can be connected to form a complete raceway as shown in FIG. 30. It will be appreciated that the length of the track may vary as desired.

Figure 27:
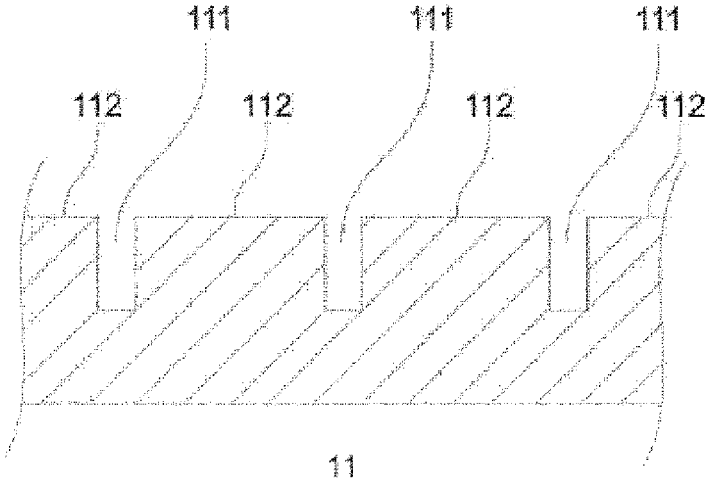
FIG. 27 is a schematic diagram showing a portion of a Multi-slot track combined raceway on which the slot car of the invention travels.

Particularly, as shown in FIG. 27, the track includes track surfaces 112 and a plurality of recessed track slots 111. The track slots 111 and the track surfaces 112 are arranged alternately, and the positioning end 1224 of the slot-pin is inserted in the track slot 111 to guide the slot car to travel on the track. The track slot and the slot-pin of the slot car matches with each other by engagement, the adjusting assembly of the slot car adopts the movement of the slot-pin in the track slot, to enable the slot car to switch from one track slot to another track slot by cooperating with the power mechanism of the slot car.

The track surface of the Multi-slot track combined raceway provides room large enough for the travelling of the body, and the track slots provide room large enough for the movement of the adjusting assembly, so that the Multi-slot track combined raceway may be used for slot switching with the assistance of the adjusting assembly.

The description below illustrates beneficial effects of the invention. With the provided adjusting assembly, the annular guide channel of the guiding component annularly limits the position of the slot-pin, while the position limiter of the rotating component longitudinally limits the position of the slot-pin, thereby enabling the slot car to switch between slots. During a race, the slot car is enabled to intercept or block its counterparts by switching slots of the tracks, as a result, the entertainment, attraction and excitation of the slot car is enhanced.

Further, an identity coding module is introduced to the body of the slot car to record a race result, and a racer can download a winning record of racing over the Internet, so as to provide an information space for race result sharing that is more encouraging and broader.

The above detailed description of the present invention with reference to the drawings is provided to illustrate the invention, but not limit the invention to the particular embodiments, that is, the above detailed implementations are illustrative but not limiting. Many modifications may be made to the invention by those skilled in the art in light of the above teaching, without departing from the principle and scope defined by the claims of the invention. All the modifications fall within the scope of the invention.

The invention claimed is:

1. A slot car comprising a body and a power mechanism for driving the body, further comprising an adjusting assembly used for track switching of the body, wherein the adjusting assembly includes a rotating component driven by the power mechanism, a guiding component fixed on the body, and a plurality of slot-pins, the guiding component includes a guide channel used for annular position limiting of the slot-pin and a plurality of position limiters used for longitudinal position limiting of the slot-pin, and the rotating of the rotating component enables the sliding of the slot-pin within the guide channel.

2. The slot car of claim 1, wherein the guide channel comprises a lower spot along a longitudinal direction of the guide channel.

3. The slot car of claim 2, wherein the guiding component comprises an annular shell fixed on the body, and the guide channel is provided on an internal wall of the shell.

4. The slot car of claim 2, wherein the guiding component comprises an annular shell fixed on the body, the shell is provided internally with a cylinder fixedly, and the guide channel is fixed on the cylinder.

5. The slot car of claim 2, an identity coding module used for recording a race result is provided in the body, and the identity coding module includes an interface for transmitting information to the Internet.

6. The slot car of claim 1, wherein the guide channel comprises two lower spots arranged symmetrically along a longitudinal direction of the guide channel.

7. The slot car of claim 3, wherein the guiding component comprises an annular shell fixed on the body, and the guide channel is provided on an internal wall of the shell.

8. The slot car of claim 6, wherein the guiding component comprises an annular shell fixed on the body, the shell is provided internally with a cylinder fixedly, and the guide channel is fixed on the cylinder.

9. The slot car of claim 6, an identity coding module used for recording a race result is provided in the body, and the identity coding module includes an interface for transmitting information to the Internet.

10. The slot car of claim 1, wherein the guiding component comprises an annular shell fixed on the body, and the guide channel is provided on an internal wall of the shell.

11. The slot car of claim 10, an identity coding module used for recording a race result is provided in the body, and the identity coding module includes an interface for transmitting information to the Internet.

12. The slot car of claim 1, wherein the guiding component comprises an annular shell fixed on the body, the shell is provided internally with a cylinder fixedly, and the guide channel is fixed on the cylinder.

13. The slot car of claim 1, wherein the position limiter is a U-shaped chute.

14. The slot car of claim 1, wherein the position limiter comprises two parallel baffles.

15. The slot car of claim 1, wherein the slot-pin comprises a positioning end and a guiding end arranged perpendicularly with respect to the positioning end.

16. The slot car of claim 1, wherein the rotating component comprises a connecting pole connected with the power mechanism, and the connecting pole is fixedly connected with the plurality of position limiters.

17. The slot car of claim 16, wherein the rotating component includes a base, on which the connecting pole and the position limiters are fixed.

18. The slot car of claim 17, an identity coding module used for recording a race result is provided in the body, and the identity coding module includes an interface for transmitting information to the Internet.

19. The slot car of claim 1, an identity coding module used for recording a race result is provided in the body, and the identity coding module includes an interface for transmitting information to the Internet.

20. A Multi-slot track combined raceway on which the slot car of claim 1 travels, comprising a plurality of connected tracks, wherein the tracks includes a plurality of recessed track slots used for engaging with a slot-pin of the slot car, and an adjust component of the slot car is used for adjusting the movement of the slot-pin within the track slot so that the slot car is allowed to switch from one track slot to another track slot.

* * * * *